US005225239A

United States Patent [19]

Ostin

[11] Patent Number: 5,225,239

[45] Date of Patent: Jul. 6, 1993

[54] ELECTROSTATIC SPRAY COATING APPARATUS FOR APPLYING TWO COMPONENT MIXTURE

[75] Inventor: Richard M. Ostin, Farmington, Mich.

[73] Assignee: Behr Industrial Equipment, Rochester Hills, Mich.

[21] Appl. No.: 639,139

[22] Filed: Jan. 9, 1991

Related U.S. Application Data

[63] Continuation-in-part of Ser. No. 322,557, Mar. 13, 1989, abandoned.

[51] Int. Cl.[5] ..... B04D 1/34

[52] U.S. Cl. ..... 427/8; 427/458; 427/426; 118/688; 118/692; 118/697; 118/712; 118/683

[58] Field of Search ..... 118/688, 692, 697, 712, 118/683; 427/8, 426, 458; 239/61

[56] References Cited

U.S. PATENT DOCUMENTS

| | | | |
|---|---|---|---|
| 3,307,789 | 3/1967 | Clark | 427/426 X |
| 4,019,653 | 4/1977 | Scherer et al. | 239/61 X |
| 4,493,286 | 1/1985 | Carson | 118/688 X |
| 4,745,011 | 5/1988 | Fukuta et al. | 427/426 |
| 4,822,647 | 4/1989 | Nozaki et al. | 118/692 X |

*Primary Examiner*—Michael Lusigan
*Assistant Examiner*—Benjamin L. Utech
*Attorney, Agent, or Firm*—Reising, Ethington, Barnard, Perry & Milton

[57] ABSTRACT

A spray coating apparatus (10) for applying a paint composed of a controlled mixture of two liquid components. A first gear pump (32) is disposed in a spray booth (30) and pumps the first component to an applicator (14). A second gear pump (36) in the spray booth (30) pumps the second component to the applicator (14). A manifold (44) is disposed between the two gear pumps (32, 36) and the applicator (14) for converging the two paint components. A variable speed motor (16, 20) controls the rate of fluid pumped by each of the gear pumps (32, 36). Each motor (16, 20) includes an encoder (27, 29) sending feedback signals to an adjustor module (24) which computes an instantaneous ratio between the volumetric flow rates of the first and second components and compares this instantaneous ratio with a reference ratio, then adjusts the instantaneous speed of each motor (16, 20) thereby adjusting the ratio between the volumetric flow rates of the first and second components with respect to the reference ratio.

28 Claims, 3 Drawing Sheets

ELECTROSTATIC SPRAY COATING APPARATUS FOR APPLYING TWO COMPONENT MIXTURE

This is a continuation in part of U.S. Ser. No. 07/332,557, filed Mar. 13, 1989, abandoned.

TECHNICAL FIELD

The subject invention relates to electrostatic spray coating apparatuses, and more particularly to an apparatus for applying a coating material composed of a controlled mixture of at least two liquid components.

BACKGROUND ART

Electrostatic spray coating apparatuses are typically supplied with a fluid which is electrically charged either before or after atomization, then applied to an electrically grounded workpart.

In non-electostatic coating applications, coating materials composed of a mixture of two components have been found to provide superior results. The two component coating materials, typically, comprise a paint component and a hardener component which are thoroughly mixed together at a predetermined optimum ratio to provide a fast-drying, hard material.

There are generally two reasons why two component coating materials are considered nonadaptable to the electrostatic spray coating art. The first is that, because two component materials harden very fast when mixed at the proper proportions, they cannot be mixed together until just prior to application. Therefore, the mixing must take place within the spray booth at a location proximately upstream of the applicator. This requirement leads to the second, and more basic, reason why two component systems are rare in the electrostatic spray coating art. Namely, the two components must be mixed together at very precise proportions in order to achieve their advantageous results over single component materials. Even minute variations from the optimum mixing ratios can result in serious coating flaws, e.g., inability to harden, cracking, peeling, etc.

The prior art Behr Industrieanlaegen "Audi 001" spray coating apparatus mixes two paint components prior to application. This system employs two 5-phase 60 volt DC stepper motors to drive separate gear pumps through a 3:1 gearbox. Proximity sensors are used to sense motor speed.

SUMMARY OF THE INVENTION AND ADVANTAGES

The subject invention provides a spray coating apparatus of the type for applying a coating material composed of a controlled mixture of at least two liquid components onto a workpart. The apparatus comprises a first pump means for pumping an adjustable volumetric flow rate of the first component to an applicator. The first pump means includes a first motor having an adjustable speed for controlling the rate of fluid pumped by the first pump means and providing feedback signals in response to the instantaneous speed thereof. A second pump means is provided for pumping an adjusting volumetric flow rate of the second component to the applicator. The second pump means includes a second motor having an adjustable speed for controlling the rate of fluid pumped by the second pump means and providing feedback signals in response to the instantaneous speed thereof. The subject invention is characterized by including an automatic adjustor means responsive to the feedback signals from the first and second motors for computing an instantaneous ratio of the volumetric flow rate of the first and second components and comparing the instantaneous ratio with a reference ratio of the volumetric flow rates of the first and second components and individually adjusting the speeds of the first and second motors to continually adjust the instantaneous ratio between the volumetric flow rates of the first and second components into conformity with the reference ratio.

The subject invention also contemplates a method for spray coating workparts with a coating material composed of a controlled mixture of at least two liquid components, comprising the steps of pumping a first component to an applicator, controlling the flow rate of the first component with an adjustable speed first motor, sending feedback signals in response to the instantaneous speed of the first motor, pumping a second component to the applicator, controlling the flow rate of the second component with an adjustable speed second motor, and sending feedback signals in response to the instantaneous speed of the second motor. The method is characterized by computing an instantaneous ratio of the volumetric flow rate of the first and second components and comparing the instantaneous ratio to a reference ratio of the volumetric flow rate of the first and second components and individually adjusting the speeds of the first and second motors to continuously adjust the instantaneous ratio between the flow rates of the first and second components into conformity with the reference ratio.

The subject invention continuously ensures that the precise predetermined ratio between the two components is maintained throughout the coating operation. The automatic adjustor means constantly compares the instantaneous ratio produced by the first and second motors to the reference ratio and makes adjustments in response to the comparisons made, so that the instantaneous ratio of the two components mixed is continually maintained at the reference ratio.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a spray coating apparatus of the type for applying a coating material composed of a controlled mixture of at least two liquid components is generally shown at 10. The apparatus 10 is particularly adapted for electrostatically coating workparts, and more specifically to coating automotive vehicle bodies. In the coating of motor vehicle bodies, it has been found desirable to apply a coating material which is composed of a precisely controlled mixture, or ratio, of two liquid components. Typically, these components comprise a paint and a hardener. The paint and hardener are mixed at an exact ratio and then immediately sprayed onto the workpart to provide a fast-drying hard coating. If the ratio between the paint and the hardener varies even slightly during the coating of a workpart, undesirable results may occur. For example, the appearance of the finished workpart may become visibly flawed, the coating may never fully harden, the coating may bubble or peel, or the resultant color of the coating may be impaired. Therefore, it is critical that the ratio between the paint and hardener be continually monitored to ensure that the precise mixture ratio is maintained throughout the duration of the coating process.

Figure 1:
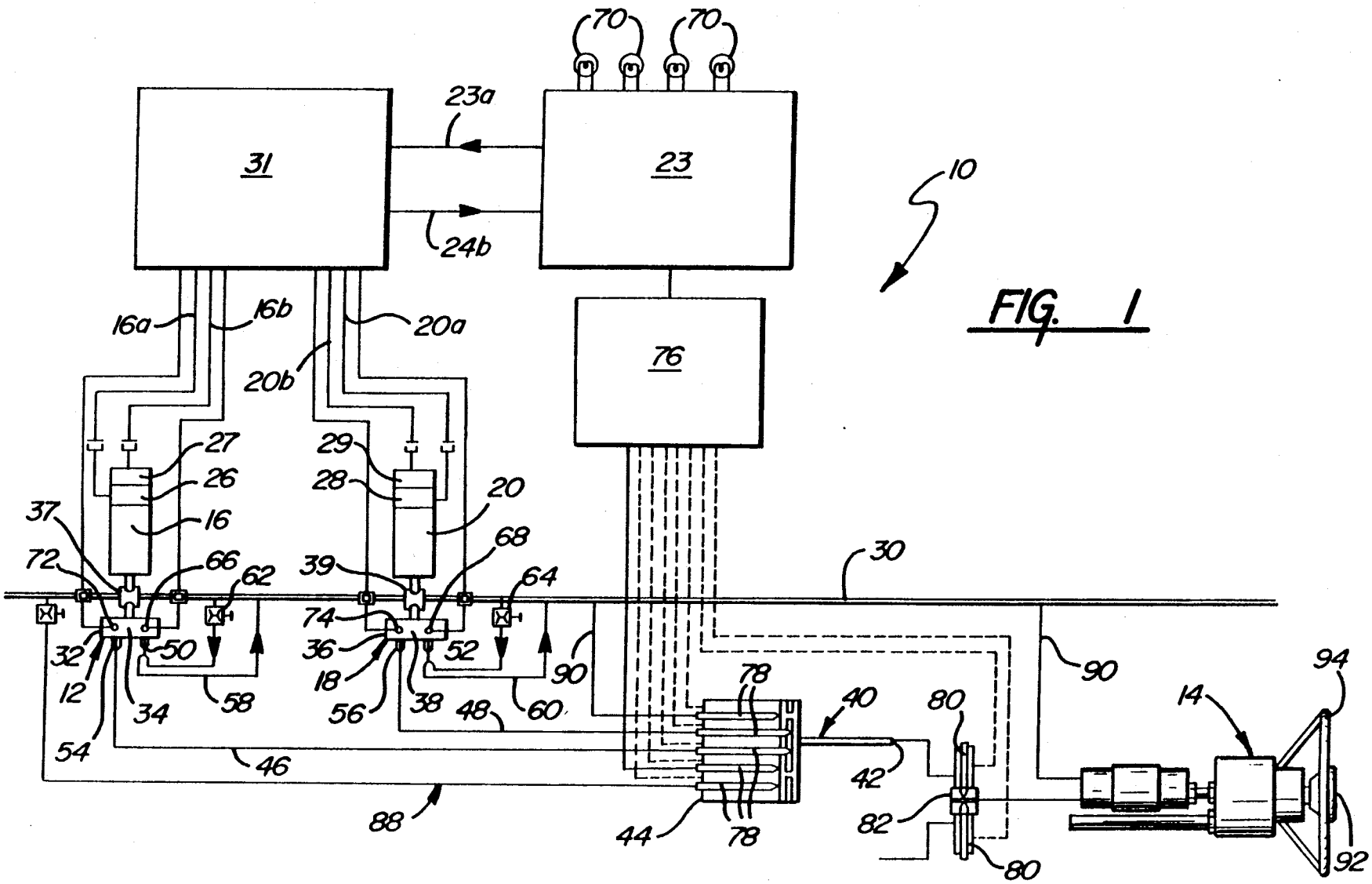
FIG. 1 is a diagrammatic view of an electrostatic spray coating apparatus according to the subject invention including an automatically operated applicator.
Figure 2:
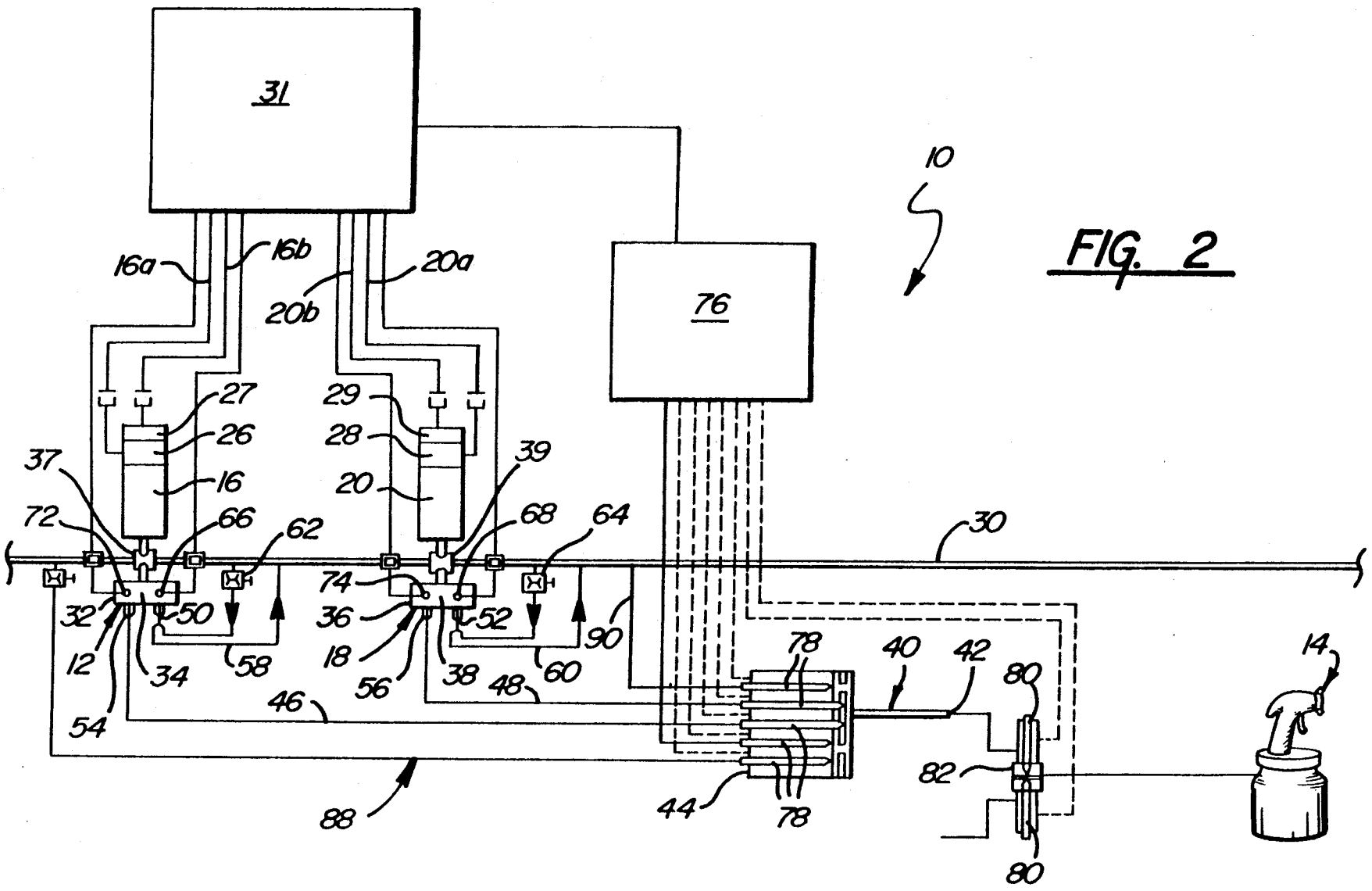
FIG. 2 is a diagrammatic view of a spray coating apparatus according to the subject invention including a manually operated applicator.

The subject apparatus 10 includes a first pump means, generally indicated at 12 in FIGS. 1 and 2, for pumping an adjustable volumetric flow rate of the first component, i.e., paint. An applicator means, generally indicated at 14, is provided downstream of the first pump means 12. The first pump means 12 includes a first motor 16 having an adjustable speed for controlling the rate of fluid pumped by the first pump means 12. The first motor 16 also provides feedback signals along line 16*a* in response to the instantaneous speed thereof, as will be described in detail subsequently.

The apparatus 10 also includes a second pump means, generally indicated at 18, for pumping an adjustable volumetric flow rate of the second component, i.e., hardener, to the applicator means 14. The second pump means 18 includes a second motor 20 having an adjustable speed for controlling the rate of fluid pumped by the second pump means 18. Similar to the first motor 16, the second motor 20 also provides feedback signals along line 20*a* in response to the instantaneous speed thereof.

The first 16 and second 20 motors are brushless servomotors operating on AC current. This gives excellent control of the RPM of each motor 16, 20 so that the first 12 and second 18 pump means can be accurately controlled.

Figure 3:
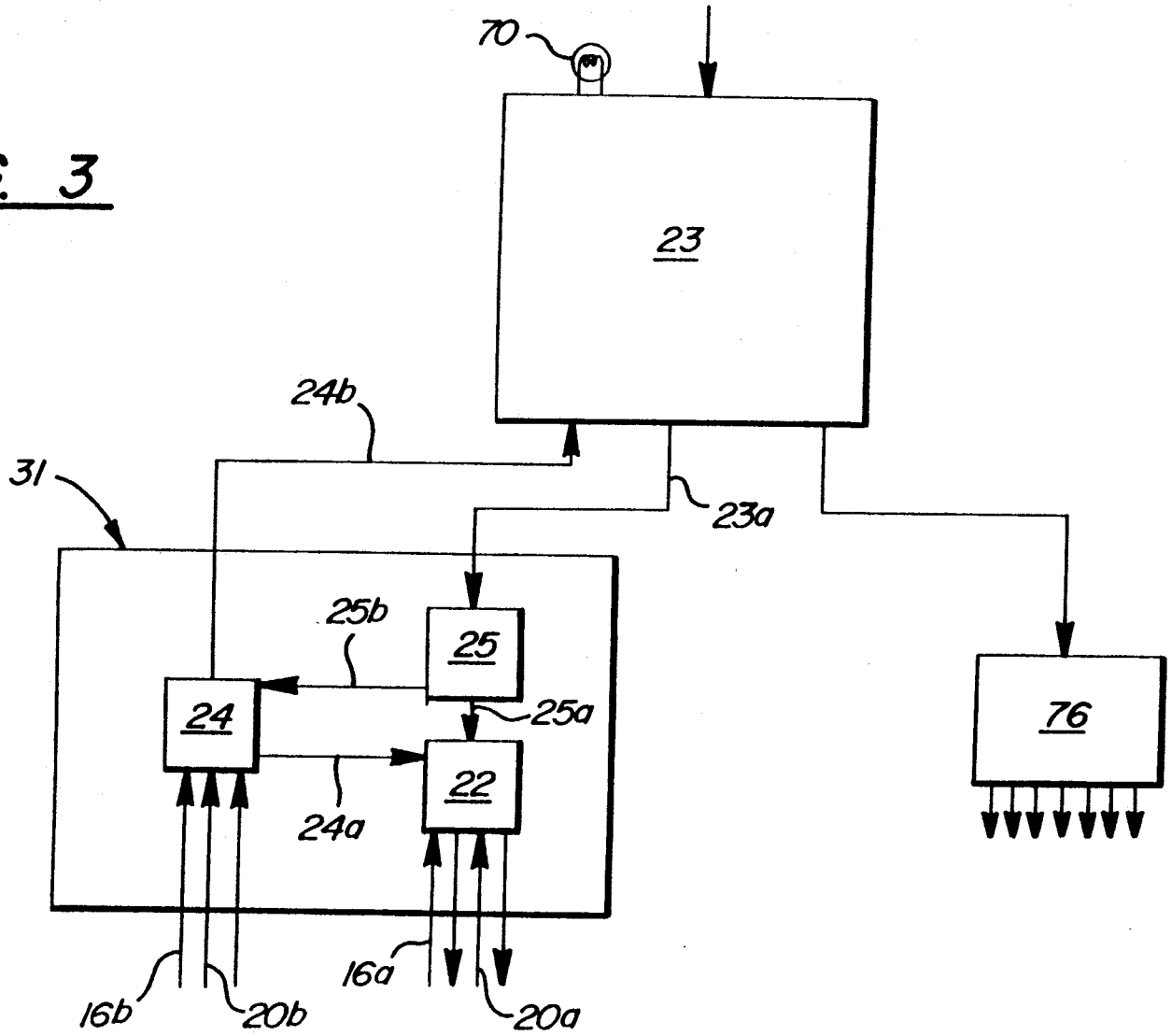
FIG. 3 is a schematic diagram of the host controller means, the control panel, and the valve actuator means according to the subject invention.

A motor drive means, generally indicated at 22 in FIG. 3, is responsive to input signals, including reference speed signals, for individually controlling the speeds of the first 16 and second 20 motors. An operator of the spray coating apparatus 10 can program the precise reference speeds into a host controller means 23, which in turn, provides an input signal to the motor drive means 22. These reference speeds are directly proportional to the specific ratios at which the paint and hardener components are mixed to yield the final coating material. As best shown in FIG. 3, an interface 25 is provided between the motor drive means 22 and the host controller means 23. Information in the form of computer language is transferred along the line 23*a* from the host controller means 23 to the interface 25. The interface 25 converts this information to machine language and sends it to the motor drive means 22 via line 25*a*. Preferably, the line 23*a* is a data bus for quickly conveying the information to the motor drive means 22.

The first 16 and second 20 motors each include a tachometer 26, 28, respectively, which send motor speed feedback signals directly to the motor drive means 22, along respective lines 16*a* and 20*a*, so that the motor drive means 22 can continuously readjust the instantaneous speed of each motor to the preprogrammed reference speeds. The tachometers 26, 28, in other words, provide feedback to the motor drive means 22 to ensure that the first 16 and second 20 motors are operating at the speeds commanded by the motor drive means 22. The first 16 and second 20 motors are also provided with optical encoders 27, 29, respectively, for sending feedback signals 16*b*, 20*b*, respectively, as will be described presently.

The subject invention is characterized by including an automatic adjustor means, generally indicated at 24 in FIG. 3, which is responsive to feedback signals 16*b*, 20*b* from the encoders 27, 29 of on the first 16 and second 20 motors, respectively, for computing an instantaneous ratio of the volumetric flow rate of the first and second components and then comparing the instantaneous ratio to a reference ratio of the volumetric flow rate of the first and second components transmitted from the host controller means 23. The adjustor means 24 then individually adjusts the speeds of the first 16 and the second 20 motors to continually adjust the instantaneous ratio between the volumetric flow rates of the first and second components into conformity with the reference ratio.

The adjustor means 24, in other words, receives instantaneous feedback signals 16*b*, 20*b* from each of the first 16 and second 20 motors. The adjustor means 24 then uses these feedback signals 16*b*, 20*b* to compute an instantaneous ratio, and then compares the instantaneous ratio with the reference ratio, corresponding to the optimal paint and hardener mixing ratio, to ensure that the mixture of the first and second components conforms to the precise predetermined reference ratio. If discrepancies are determined, the adjustor means 24 will then send a signal via line 24*a* to the motor drive means 22 instructing the motor drive means 22 to adjust the speed of one or both of the first 16 and second 20 motors. In this manner, the predetermined ratio between the paint and hardener can be precisely mixed and maintained at all times during the coating operation.

The reference speeds and ratios are transmitted from the host controller means 23, based upon input from an operator. Such operator input may be in the form of selecting a program having preselected ratios and motor speeds. These references originally travel through the line 23*a* and into the interface 25. The interface then supplies the reference ratios to the adjustor means 24 via a line 25*b* and the reference speeds to the motor drive means 22 via the line 25*a*.

Preferably, the adjustor means 24, motor drive means 22 and interface 25 are contained within one control panel, generally indicated at 31 in FIGS. 1, 2 and 3. The control panel 31 is constructed so as to be readily replaceable in the event a malfunction occurs. A service technician need not trace the problem to a specific one of the elements 22, 24, 25 within the control panel 31, but instead can quickly install a new control panel 31 and thereby reduce system down time. Although the control panel 31 is shown in the Figures as controlling only one applicator means 14, the control panel 31 is capable of controlling up to four applicator means 14 simultaneously.

A spray booth 30 is provided for containing the sprayed flammable coating material in an isolated zone. In FIGS. 1 and 2, only one wall of the spray booth 30 is represented, but it will be appreciated that the spray booth 30 defines a complete enclosure. The spray booth 30 encloses the automobile bodies while they are painted to contain the over-sprayed coating material.

The atmosphere inside the spray booth 30 is considered hazardous due to the highly ignitable mixture of air and atomized paint particles. For this reason, the atmosphere inside the spray booth is constantly circulated by using large fans. The emissions exhausted from the spray booth 14 are directed out of a stack.

The first pump means 12 includes a first gear pump 32 having intermeshing rotors supported within a first housing 34 and operatively connected to the first motor 16. Similarly, the second pump means 18 includes a second gear pump 36 having intermeshing rotors supported within a second housing 38 and operatively connected to the second motor 20. The first 32 and second 36 gear pumps are of the positive displacement volumetric type wherein the volumetric flow rate of the paint components therethrough is proportional to the angular velocity of the rotors, as controlled by the motors 16, 20.

As shown in FIGS. 1 and 2, the first 32 and second 36 gear pumps are disposed inside of the spray booth 30 while the first 16 and second 20 motors are disposed outside of the spray booth. The first 16 and second 20 motors are positioned outside of the spray booth 30 so that they can operate in a non-hazardous environment. Therefore, a first coupler means 37 is disposed between the first motor 16 and first gear pump 32 for providing an electrically insulated mechanical coupling through the spray booth 30. Likewise, a second coupler means 39 is disposed between the second motor 20 and the second gear pump 36 for providing an electrically insulated mechanical coupling through the spray booth 30.

A mixer means, generally indicated at 40 in FIGS. 1 and 2, is disposed in the spray booth 30 for mixing the first and second components of the coating material and discharging the mixture from an output 42 thereof. Preferably, the mixer means 40 is of the kinetics type to effectively and efficiently mix the two components as they travel to the applicator means 14. The inlet to the mixer means 40 comprises a five medium inlet manifold block 44.

A first conduit 46 is associated with the first gear pump 32 and extends from a first component supply outside of the spray booth 30 to the manifold 44 of the mixer means 40. Likewise, a second conduit 48 is associated with a second gear pump 36 and extends from a second component supply outside of the spray booth 32 to the manifold 44 of the mixer means 40. The applicator means 14 communicates with the output 42 from the mixer means 40 for applying the mixed first and second components of the coating material onto the workpart. That is, the applicator means 14 is downstream of the mixer means 40 and thereby receives the mixed coating material for application onto a workpart.

The first 34 and second 38 housings of the gear pumps 32, 36 each include an upstream inlet 50, 52, respectively, and a downstream outlet 54, 56, respectively. The first conduit 46 includes a recirculation line 58 disposed between the first component supply and the first housing inlet 50. Similarly, the second conduit 48 includes a recirculation line 60 disposed between the second component supply and the second housing inlet 52. The recirculation lines 58, 60 allow each of the unmixed components to continue flowing even while the associated gear pump 34, 38 is not pumping so that the component of the coating material will not harden or allow particulate suspended therein to precipitate out.

A manually operated fluid regulator 62, 64 is disposed on each of the first 46 and second 48 conduits between their respective supplies in the inlets 50, 52 to their respective housings 54, 58. These flow regulators 62, 64 are adjusted to an optimal setting and remain at that setting throughout the coating operation. The regulators 62, 64 can be completely closed when servicing the gear pumps 34, 38 to prevent waste.

The first 12 and second 18 pump means each include an upstream pressure sensing means 66, 68, respectively, disposed adjacent the upstream inlets 50, 52 of the respective first 34 and second 38 housings for sensing when the static pressure in the respective first 46 and second 48 conduits, upstream of the inlets 50, 52 falls below a predetermined value. Preferably, the upstream pressure sensing means 66, 68 comprise pressure transducers which send a signal to a fault indicator 70 when the pressure falls below a predetermined value.

Similarly, the first 12 and second 18 pump means also include downstream pressure sensing means 72, 74, respectively, disposed adjacent the downstream outlets 54, 56 of the respective first 34 and second 38 housings for sensing when the static pressure in the respective first 46 and second 48 conduits, downstream of the outlets 54, 56, rises above a predetermined value. Like the upstream pressure sensing means 66, 68, the downstream pressure sensing means 72, 74 comprise pressure transducers relaying a fault signal to a fault indicator 70 when the pressure rises above a predetermined value.

A plurality of pneumatically actuated valves are disposed in the spray booth 30 for opening and closing flow passages at predetermined times. More specifically, a valve actuator means 76 is provided for individually actuating the valves at predetermined times in the workpiece coating process. The valve actuator means 76 preferably comprises an array of solenoid valves communicating with the main air supply for individually supplying a pneumatic signal to an associated one of the valves 78, 80. For example, a pneumatically actuated valve 78 is associated with each inlet to the manifold 44 for allowing the associated flow to enter the mixer means 40. Similarly, two pneumatically actuated valves 80 are associated with a two-way select valve 82 between the mixer means 40 and the applicator means 14 for selecting between the coating material mixed from the two components or from an alternative single component fluid control system (not shown). Further, not shown, a pneumatically actuated valve is disposed in the applicator means 14 for shutting off the flow of coating material to be discharged.

A flushing means, generally indicated at 88 in FIGS. 1 and 2, is associated with the mixer means 40 for flushing residual coating material from the mixer means 40 and the applicator means 14. One of the valves 78 of the manifold 44, when pneumatically actuated, allows the flow of solvent through the manifold 44 and into the mixing means 40 to clean residual paint therefrom. The solvent travels through the outlet 42 of the mixer means 40, then through the two-way select valve 82 and into the applicator means 14. A recovery line 90 is provided from both the applicator means 14 and the manifold 44 for allowing spent solvent to be conducted to a waste collection system.

As referred to previously, a .host controller means, generally indicated at 90 in FIGS. 1 and 3, is provided outside of the spray booth 30 for supplying reference values to the motor drive means 22 and the adjustor means 24 and for controlling the valve actuator means 76 in response to preprogrammed commands. An operator of the subject assembly 10 controls and monitors the spray coating operation, including the designation of the reference values and other parameters, through the host controller means 90. Although in the described embodiment only one control panel 31 is shown, the host controller means 23 is capable of controlling a plurality of control panels 31, and each control panel 31 is capable of controlling up to four applicator means 14. Numerous fault indicators 70 provide indicia of important occurrences. Information of these important occurrences is relayed to the host controller means 90 via line 24*b* of the adjustor means 24. Preferably, the line 24*b* comprises an RS-232 transmission line.

As shown in FIG. 1, the applicator means 14 may include a rotary atomizer 92 fixedly mounted in the spray booth 30. Electrostatic charging means 94 is associated with the applicator means 14 for applying an electrostatic charge to the spray coating material. As shown, the electrostatic charging means 14 may comprise an annular ring disposed about the rotary atomizer 92 including a plurality of circumferentially disposed charging electrodes which impart a high electrical potential to the sprayed coating material by corona discharge. Alternatively, surface charging may be used.

Alternatively, as shown in FIG. 2, the applicator means 14 may include a manually controllable atomizer which is hand operated inside the spray booth. In the manually controllable embodiment, the host controller means 90 can be eliminated as all coating decisions are made by the operator. The ratios between the two components need only be stored as a reference value in the adjustor means 24. The downstream pressure sensing means 72, 74 becomes extremely important in this embodiment due to tendency of the operator to only partially pull the atomizer trigger. This can cause significant pressure build-up in the conduits 46, 48 downstream of the gear pumps 34, 38 and result in rupture of the lines. The downstream pressure sensors 72, 74, therefore, provide warning signals or supply a signal to shut down the first 16 and second 20 motors when the static pressure in the conduits 46, 48 exceeds a maximum value.

The method for spray coating workparts with a coating material composed of a controlled mixture of two liquid components will be addressed presently. The steps comprise pumping the first component through the first gear pump 32 to the applicator means 14; controlling the flow rate of the first component pumped by the first gear pump 32 with an adjustable speed first motor 16; sending feedback signals to the adjustor means 24 in response to the instantaneous speed of the first motor 16; pumping the second component through the second gear pump 36 to the applicator means 14; controlling the flow rate of the second component pumped by the second gear pump 36 with an adjustable speed second motor 20; sending feedback signals to the adjustor means 24 in response to the instantaneous speed of the second motor 20; and then individually controlling the speeds of the first 16 and second 20 motors with the motor drive means 22 in response to an input reference speed signal from the host controller means 23. The method of the subject invention is characterized by computing an instantaneous ratio of the volumetric flow rate of the first and second components and comparing the instantaneous ratio to a reference ratio stored in the adjustor means 24 and then individually adjusting the speeds of the first 16 and second 20 motors via the motor drive means 22 so that the instantaneous ratio between the flow rates of the first and second components is continuously adjusted into conformity with the reference ratio also supplied from the host controller means 23.

The adjustor means 24, in other words, acts as a liaison between the host controller means 23, the two motors 16, 20 and the motor drive means 22 by monitoring the performance of each of the motors 16, 20, then comparing their performance to the reference commands of the host controller means 23 and finally instructing the motor drive means 22 to make any necessary corrections. By making these continuous comparisons between the effects of the operating speeds of the first 16 and second 20 motors, the adjustor means 24 ultimately ensures that the mixing ratio of the two components of the coating material remain at the optimum value throughout the entire spray coating process.

As the speeds of the motors 16, 20 are individually controlled by the motor drive means 22 in response to the input reference signals from the host controller means 23, the motor drive means 22 performs the additional function of continuously readjusting the instantaneous speeds of each of the first 16 and second 20 motors to the reference speeds. This step is distinguished from the comparison steps performed by the adjustor means 24 in that the motor drive means 22 considers the instantaneous speed of one motor without reference to the speed of the other motor. That is, the motor drive means 22 does not compare the operating performance between the two motors 16, 20, but merely receives a feedback signal from respective tachometers 26, 28 to ensure that the motors 16, 20 are operating at the speeds commanded by either the host controller means 23 or the adjustor means 24. Therefore, a two tier system of quality control is established to ensure that the final ratio between the two components is maintained at an optimum established value.

As the first and second components are pumped through the respective gear pumps 32, 36, the upstream pressure sensing means 66, 68 continually measure the static pressure of the components at positions upstream of the gear pumps 32, 36 to signal the appropriate fault indicators 70 in the event the static pressure of either of the first and second components falls below a predetermined value. This will provide a warning in the event an insufficient supply of the components is available from the associated supply and thereby prevent the gear pumps 32, 36 from becoming damaged. Similarly, the downstream pressure sensing means 72, 74 continually measure the static pressure of the components at positions downstream of the gear pumps 32, 36 to signal the appropriate fault indicators 70 in the event the static pressure of either of the first or second components rises above a predetermined value. This will provide warning or will shut down the first 16 and second 20 motors in the event excessive pressure builds up in the first 46 and second 48 conduits downstream of the gear pumps 32, 36 such as when the applicator means 14 is manually operated and the operator fails to fully actuate the trigger.

After traveling through the gear pumps 32, 36, the separate components are fed into the manifold 44 where the mixing takes place. The mixer means 40 is disposed a sufficient distance upstream of the applicator means 14 so that the kinetics type mixing of the components may be fully performed. The mixed coating material is then conducted directly to the applicator means 14 where it is immediately applied to a workpart. As the coating material is discharged, the sprayed coating material is electrostatically charged.

To prevent the unmixed first and second components from becoming unusable due to prolonged stagnation during periods when the gear pumps 32, 36 are not operating, the respective recirculation lines 58, 60 are provided for circulating the components to and from respective supplies.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A spray coating apparatus (10) of the type for applying a coating material composed of a controlled mixture of at least two liquid components onto a workpart, comprising: first pump means (12) for pumping an adjustable volumetric flow rate of the first component to an applicator (14), said first pump means (12) including a first motor (16) having an adjustable speed for controlling the rate of fluid pumped by said first pump means (12) and providing feedback signals in response to the instantaneous speed thereof; second pump means (18) for pumping an adjustable volumetric flow rate of the second component to the applicator (14), said second pump means (18) including a second motor (20) having an adjustable speed for controlling the rate of fluid pumped by said second pump means (18) and providing feedback signals in response to the instantaneous speed thereof; and characterized by automatic adjustor means (24) responsive to said feedback signals from said first (16) and second (20) motors for computing an instantaneous ratio of the volumetric flow rates of the first and second components and comparing said instantaneous ratio with a reference ratio of the volumetric flow rates of the first and second components and individually adjusting the speeds of said first (16) and second (20) motors to continually adjust said instantaneous ratio into conformity with said reference ratio.

2. An apparatus (10) as set forth in claim 1 further characterized by each of said first (16) and second (20) motors including a tachometer (26, 28) for sending motor speed feedback signals, and motor drive means (22) for receiving the feedback signals from said tachometers (26, 28) and continuously readjusting the instantaneous speed of each of said first (16) and second (20) motors into conformity with a reference speed.

3. An apparatus (10) as set forth in claim 2 further characterized by said first pump means (12) including a first gear pump (32) having intermeshing rotors supported within a first housing (34) and operatively connected to said first motor (16), and said second pump means (18) including a second gear pump (36) having intermeshing rotors supported within a second housing (38) and operatively connected to said second motor (20).

4. An apparatus (10) as set forth in claim 3 further characterized by including a spray booth (30) defining an isolated internal spray zone.

5. An apparatus (10) as set forth in claim 4 further characterized by said first (32) and second (36) gear pumps disposed inside said spray booth (30) and said first (16) and second (20) motors disposed outside of said spray booth (30).

6. An apparatus (10) as set forth in claim 5 wherein said apparatus (10) includes a plurality of pneumatically actuated valves (78, 80) disposed in said spray booth (30) for opening and closing fluid flow passages, further characterized by including valve actuator means (76) for individually actuating said valves (78,80) at predetermined times in the workpiece coating process.

7. An apparatus (10) as Set forth in claim 6 further characterized by including mixer means (40) disposed in said spray booth (30) for mixing the first and second components of the coating material and discharging the mixture from an output (42) thereof.

8. An apparatus (10) as set forth in claim 7 further characterized by including a first conduit (46) associated with said first gear pump (32) and extending from a first component supply outside of said spray booth (30) to said mixer means (40), and a second conduit (48) associated with said second gear pump (36) and extending from a second component supply outside of said spray booth (30) to said mixer means (40).

9. An apparatus (10) as set forth in claim 8 further characterized by including applicator means (14) communicating with said output (42) from said mixer means (40) for applying the mixed first and second components of the coating material onto the workpart.

10. An apparatus (10) as set forth in claim 9 wherein said first (32) and second (36) gear pump housings each include an upstream inlet (50, 52) and a downstream outlet (54, 56), further characterized by said first conduit (46) including a recirculation line (58) disposed between the first component supply and said first housing inlet (50), and said second conduit (48) including a recirculation line (60) disposed between the second component supply and said second housing inlet (52).

11. An apparatus (10) as set forth in claim 10 further characterized by each of said first (12) and second (18) pump means including upstream pressure sensing means (66, 68) disposed adjacent said upstream inlet (50, 52) of respective said first (32) and second (34) housings for sensing when the static pressure in respective said first (46) and second (48) conduits upstream of said inlets (50, 52) falls below a predetermined value.

12. An apparatus (10) as set forth in claim 11 further characterized by each of said first (12) and second (18) pump means including downstream pressure sensing (72, 74) means disposed adjacent said downstream outlet (54, 56) of respective said first (34) and second (36) housings for sensing when the static pressure in respective said first (46) and second (48) conduits downstream of said outlets (54, 56) rises above a predetermined value.

13. An apparatus (10) as set forth in claim 12 further characterized by including first coupler means (37) for providing an electrically insulated mechanical coupling through said spray booth (30) between said first motor (16) and said first gear pump (32).

14. An apparatus (10) as set forth in claim 13 further characterized by including second coupler means (39) for providing an electrically insulated mechanical coupling through said spray booth (30) between said second motor (20) and said second gear pump (36).

15. An apparatus (10) as set forth in either of claims 7 or 14 further characterized by including a host controller means (23) disposed outside of said spray booth (30) for supplying reference values to said motor drive means (22) and said adjustor means (24) and controlling said valve actuator means (76) in response to preprogrammed commands.

16. An apparatus (10) as set forth in claim 15 further characterized by including flushing means (88) associated with said mixer means (40) for flushing residual coating material from said mixer means (40) and said applicator means (14).

17. An apparatus (10) as set forth in claim 16 further characterized by said applicator means (14) including a rotary atomizer (92) fixedly mounted in said spray booth (30).

18. An apparatus (10) as set forth in claim 17 further characterized by including electrostatic charging means (94) associated with said applicator means (14) for applying an electrostatic charge to the sprayed coating material.

19. An apparatus (10) as set forth in claim 18 further characterized by said applicator means (14) including a manually controllable atomizer.

20. An apparatus (10) as set forth in claim 19 further characterized by said host controller means (23) including a fault indicator (70) associated with each of said first (66) and second (68) upstream sensing means and said first (72) and second (74) downstream sensing means.

21. A method for spray coating workparts with a coating material composed of a controlled mixture of at least two liquid components, comprising the steps of: pumping a first component to an applicator (14); controlling the flow rate of the first component with an adjustable speed first motor (16); sending feedback signals in response to the instantaneous speed of the first motor (16); pumping a second component to the applicator (14); controlling the flow rate of the second component with an adjustable speed second motor (20); sending feedback signals in response to the instantaneous speed of the second motor (20); and characterized by computing an instantaneous ratio of the volumetric flow rate of the first and second components and comparing the instantaneous ratio to a reference ratio of the volumetric flow rate of the first and second components and individually adjusting the speeds of the first (16) and second (20) motors to continuously adjust the instantaneous ratio between the flow rates of the first and second components into conformity with the reference ratio.

22. A method as set forth in claim 21 further characterized by electrostatically charging the sprayed coating material.

23. A method as set forth in claim 22 further characterized by continuously readjusting the instantaneous speed of each of the first (16) and second (20) motors to a reference speed.

24. A method as set forth in claim 23 wherein a first gear pump (32) pumps the first component and a second gear pump (36) pumps the second component, further characterized by measuring the static pressure of the first and second components at positions upstream and downstream of the respective first (32) and second (36) gear pumps.

25. A method as set forth in claim 24 further characterized by signaling a fault indicator (70) in the event the static pressure of at least one of the first and second components upstream of the respective first (32) and second (36) gear pumps falls below a predetermined value.

26. A method as set forth in claim 25 further characterized by signaling a fault indicator (70) in the event the static pressure of at least one of the first and second components downstream of the respective first (32) and second (36) gear pumps rises above a predetermined value.

27. A method as set forth in claim 26 further characterized by mixing the first and second components at a position upstream of the applicator (14).

28. A method as set forth in claim 27 further characterized by circulating the first and second coating materials to and from respective supplies during periods when the first (32) and second (36) gear pumps are not operating.

* * * * *